United States Patent [19]

Gurries et al.

[11] 4,359,102

[45] Nov. 16, 1982

[54] RESONANCE AIDED EARTH-WORKING EQUIPMENT

[75] Inventors: Raymond A. Gurries, Reno; Harry J. Stormon, Sparks, both of Nev.

[73] Assignee: Resonant Technology Company, Sparks, Nev.

[21] Appl. No.: 131,989

[22] Filed: Mar. 20, 1980

[51] Int. Cl.[3] ..... E02F 3/76

[52] U.S. Cl. ..... 172/40; 30/277; 37/DIG. 18; 37/141 R; 172/816; 173/49; 173/100

[58] Field of Search ..... 172/40, 816; 37/DIG. 18; 30/272, 277, 169–172; 173/49, 162 H, 162 R, 200

[56] References Cited

U.S. PATENT DOCUMENTS

| | | | |
|---|---|---|---|
| 3,145,488 | 8/1964 | French | 172/40 X |
| 3,367,716 | 2/1968 | Bodine . | |
| 3,443,327 | 5/1969 | Martin | 172/40 X |
| 3,478,450 | 11/1969 | Cunningham . | |
| 3,628,265 | 12/1971 | Galis | 37/DIG. 18 X |
| 3,633,680 | 1/1972 | Shatto, Jr. | 172/40 X |
| 3,770,322 | 11/1973 | Cobb et al. . | |
| 3,795,070 | 3/1974 | Bronson et al. | 37/DIG. 18 X |
| 4,229,045 | 10/1980 | Gurries | 37/DIG. 18 X |
| 4,230,369 | 10/1980 | Gurries | 172/40 X |

FOREIGN PATENT DOCUMENTS

| | | | |
|---|---|---|---|
| 149003 | 10/1921 | United Kingdom | 37/DIG. 18 |

OTHER PUBLICATIONS

Society Of Automotive Engineers, Inc. "Soil Excavation Improvement From Bulldozer Blade Oscillation" 9/78.

Automotive Engineering, 11/78 pp. 74–80.

*Primary Examiner*—Paul E. Shapiro

*Attorney, Agent, or Firm*—Townsend and Townsend

[57] ABSTRACT

A bulldozer having a transversely elongate cutter blade closely spaced from the bottom edge of the mold board is disclosed. The cutter blade is mounted for reciprocal motion in forward and aft directions relative to the mold board. Unidirectional force impulses are applied to the cutter blade in a forward direction to drive the blade intermittently forward without aft motion. Preferably, the unidirectional force impulses are applied by first and second matched force transmitting beams. Each beam has two divergent approximately straight legs that meet at a juncture to form an acute, approximately 90° angle, a node at the juncture, an input anti-node at the end of one leg, and an output anti-node at the end of the other leg at the input frequency. A source of vibrations at or near the resonant frequency is coupled to the input anti-node and the output anti-node is disposed in spaced aft relationship from the cutter blade within striking distance thereof. The beams are mounted adjacent to the rear surface of the mold board so the mold board extends into the space between the legs with the input anti-node disposed near the top of the mold board and the output anti-node disposed near the bottom of the mold board.

24 Claims, 9 Drawing Figures

RESONANCE AIDED EARTH-WORKING EQUIPMENT

BACKGROUND OF THE INVENTION

This invention relates to earth-working equipment and, more particularly, to more efficient use of resonance as an aid to the operation of bulldozers and the like.

Bulldozers and like earth-working equipment such as graders and scrapers are in common use on construction sites and elsewhere. Conventionally, a steady force, i.e., the tractive force of the vehicle, furnishes the power necessary to perform the bulldozing function. A good deal of effort has been devoted to the use of vibration to facilitate earth-working operations.

Prior efforts to use vibration to aid bulldozing have for the most part taken the approach of vibrating the mold board, as typically shown in Cobb et al U.S. Pat. No. 3,770,322 and Bodine U.S. Pat. No. 3,367,716. An exception is Cunningham U.S. Pat. No. 3,478,450, in which a separate cutter blade under the bottom edge of the mold board is vibrated. The cutter blade is supported for reciprocal motion by arms pivotably attached to the mold board. A source of vibrations attached to the cutter blade assembly applies an unbalanced force to the cutter blade to set up a forced vibration of the cutter blade in forward and aft directions.

A principal problem in conventional dozers and like machines using vibration is the transmission of vibration energy to the machine itself rather than the cutter blade. Vibration is conventionally applied to the cutting blade by an eccentric oscillator in all directions about the axis of the oscillator. Only the component of such forces in the direction of the operation of the cutting blade, i.e., forwardly, are useful. All other components of force act on the machine itself and set up unwanted vibrations in the machine. Because of limitations on the size of vibration loads which can be applied to the machine, the output forces of the oscillator must be kept relatively low, greatly inhibiting the utility of the vibration system for its intended function.

SUMMARY OF THE INVENTION

According to the invention, a bulldozer or the like having a mold board coupled to a tractor is provided with a transversely elongated cutter blade closely spaced from the bottom edge of the mold board. The cutter blade is mounted for reciprocal motion in forward and aft directions relative to the mold board. A source of vibrations applies unidirectional force impulses to the blade in a forward direction to drive the blade intermittently forward without aft motion.

A feature of the invention, which is applicable to other earth-working equipment as well, is the use of one or, preferably more matched angulated force transmitting beams, each having two divergent legs that meet at a juncture to couple vibratory force to a cutter blade that extends across the bottom edge of an earth-working implement, e.g., a mold board. Each beam has a resonant frequency, a node at he juncture when restrained, an input anti-node at the end of one leg, and an output anti-node at the end of the other leg at the resonant frequency. Each beam is mounted adjacent to the rear surface of an earth-working implement so the implement extends into the space between the legs with the input anti-node disposed near the top of the implement and the output anti-node disposed near the bottom of the implement. A source of vibrations at or near the resonant frequency is coupled to each beam near its input anti-node and its output anti-node is coupled to the cutter blade to transfer thereto vibratory energy from the source. If two or more beams are employed as is preferred, they are mounted on the implement at transversely spaced apart points in balanced relationship. The described arrangement not only provides a compact resonant driving assembly, but also couples directly to the implement vibrations that favorably condition the earth in contact with the implement.

A principal advantage of the system of the present invention over prior art vibration systems is that usable forces are imparted to the blade in a forward direction, but very little vibration energy is transmitted to the machine itself. The resonant system is supported at its node, which is substantially stationary. As a result, very little in the way of input vibration force is applied to the machine itself, maximizing the input forces which can be used and minimizing their detrimental effect on the machine. Input forces of sufficient magnitude can be used so that the cutter blade will tend to fluidize the material in front of the mold board, allowing the bulldozer to cut through material which could not normally be penetrated, and reducing the friction of the material on the mold board.

The novel features which are characteristic of the invention, as to organization and method of operation, together with further objects and advantages thereof will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DESCRIPTION OF THE PREFERRED EMBODIMENT

Figure 1:
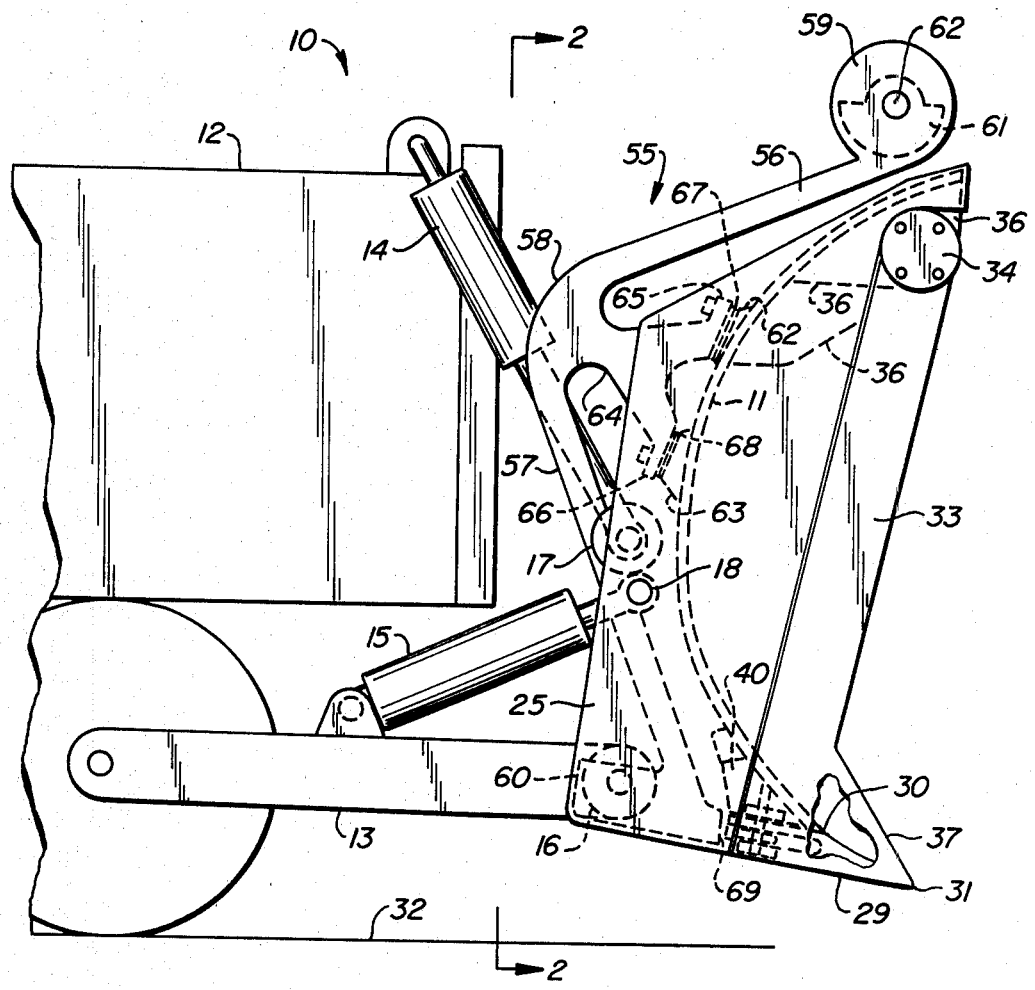
FIG. 1 is a side section view of a bulldozer incorporating the principles of the invention.
Figure 2:
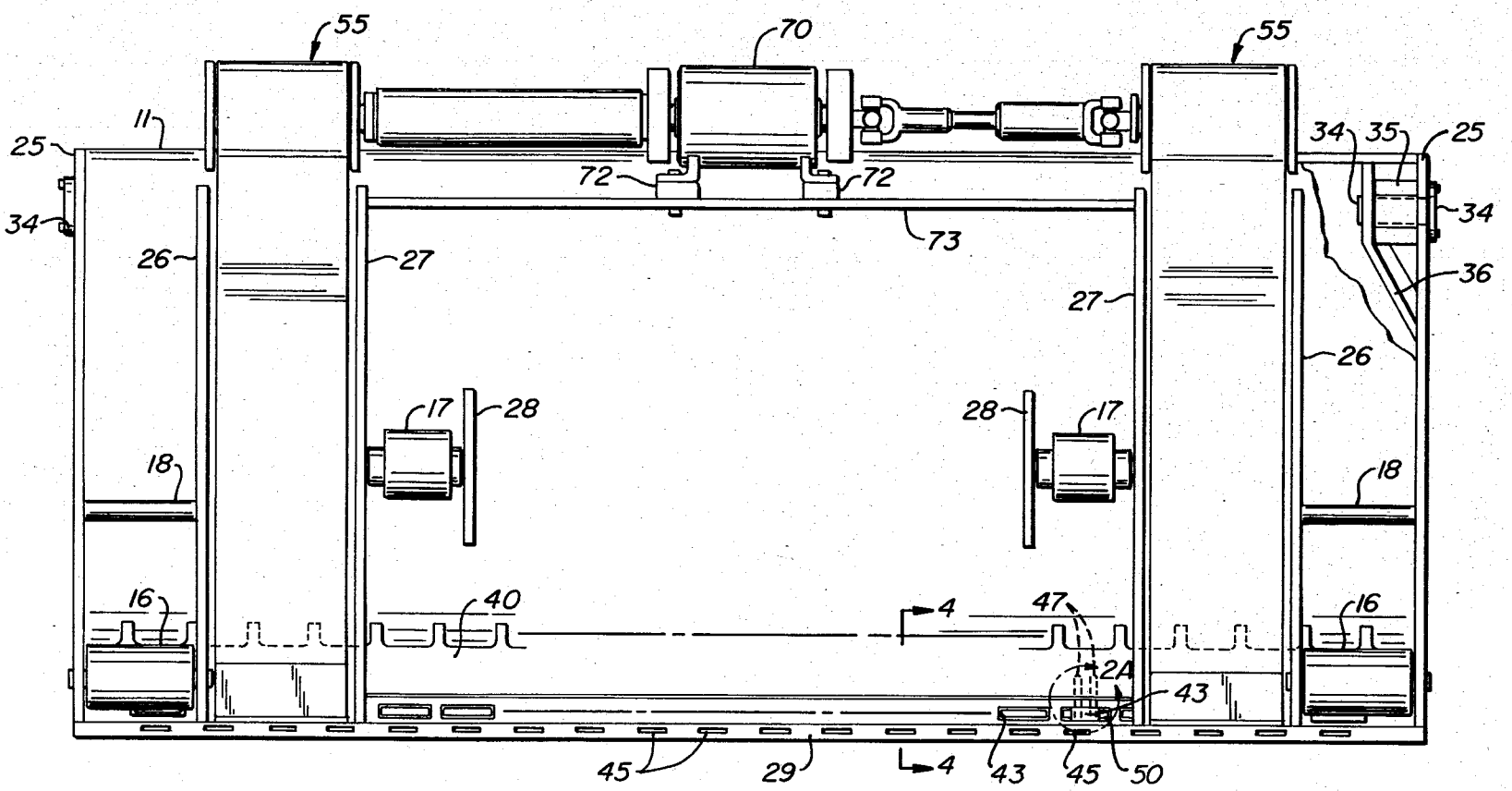
FIG. 2 is a rear elevation view of the mold board of the bulldozer taken through the plane indicated in FIG. 1

In FIG. 1 a bulldozer 10 comprises a mold board 11 and a tractor 12. Bulldozer 10 is symmetrical about a center plane extending from fore to aft, i.e., parallel to the plane of FIG. 1. Each component on one side of the center plane has a counterpart on the other side, both of which are identified by the same reference numeral. Each side of mold board 11 is coupled to tractor 12 for dozing purposes by a push beam 13, a lift cylinder 14, and a tilt cylinder 15. With additional reference to FIGS. 2 and 3, each push beam 13 is connected to mold board 11 by a shock mounted pivot 16 and each lift cylinder 14 is connected to mold board 11 by a shock mounted pivot 17. Each shock mounted pivot comprises a pivot pin surrounded by a resilient rubber brushing and a metal collar attached to the coupling member, i.e., push beam 13 or lift cylinder 14. Thus, the coupling member is attached to the pivot pin through the collar and bushing, thereby minimizing transmission of vibration from mold board 11 to tractor 12.

Each tilt cylinder 15 is connected to mold board 11 by a pivot pin 18. Vertical plates 25 are attached to the ends of mold board 11, for example by welding. Long vertical brackets 26 and 27 are attached to the back of mold board 11, for example by welding, and extend from the bottom almost to the top thereof. Short vertical brackets 28 are attached to the back of mold board 11, for example by welding, in inwardly spaced relationship from brackets 27. As thus far described, the bulldozer is, with the exception of the shock mounted pivots and the construction of the mold board 11, of conventional construction.

A transversely elongated cutter blade 29 is closely spaced from the bottom edge 30 of mold board 11 (FIG. 1). Blade 29 has a cutting edge 31 that may penetrate the surface of earth 32 during resonantly aided dozing. Cutter blade 29 extends underneath mold board 11 from side-to-side. The ends of the cutter blade 29 are attached, for example by welding, to the bottom of hanger arms 33. The head of a pin 34 is attached, for example by bolting, to the top of each of hanger arms 33. Pins 34 are each journaled for rotation in a trunion 35 supported by a bracket 36, which is attached, for example by welding, to end plate 25 and the front of mold board 11.

By virtue of the described pivotal connection, cutter blade 29 is mounted for reciprocal motion in forward and aft directions relative to mold board 11. Vertical cutter plates 37 are attached for example by welding, to the front edge of hanger arms 33 and the ends of the front portion of cutter blade 29.

Figure 2A:
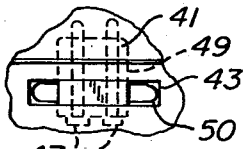
FIG. 2A is an enlargement of a portion of FIG. 2 illustrating the detail of the cutter blade stop and guide structure.

A blade stop support 40 is attached to the back of mold board 11 near its bottom edge 30, for example by welding. As more clearly illustrated in FIGS. 2A, 4, and 5, a plurality of circular recesses 41, twenty in the specific embodiment, are formed across the bottom surface of support 40. A pair of threaded bores extend upwardly from the base of each recess 41. A plurality of elongated slots 43 are equal in number to recesses 41 are formed in cutter blade 29 in alignment with the direction of movement thereof. An oblong hole 44 extends from each of slots 43 to the top surface of cutter blade 29, and an oblong hole 45 extends from each of slots 43 to the bottom surface of cutter blade 29. The elongation of holes 44 and 45 is aligned with the direction of movement of cutter blade 29, and the minor diameters of holes 44 and 45 are the same as the diameter of recess 41. Recess 41, slot 43, and holes 44 and 45 are all aligned with each other as shown in FIGS. 4 and 5.

A plurality of tool stop and guide posts 46 equal in number to recesses 41 pass through cutter blade 29 to support 40, where they are secured by a pair of threaded bolts 47, which pass through bores in posts 46, not shown, to engage the threads of bores 42. Each of posts 46, has a circular lower end portion 48, a circular upper end portion 49, and an oblong middle portion 50. The diameter of end portion 48 is slightly smaller than the minor diameter of hole 45, the diameter of end portion 49 is slightly smaller than the minor diameter of hole 44, the major and minor diameters of middle portion 50 are slightly smaller than the major and minor diameters of hole 45, and the major diameter of middle portion 50 is slightly smaller than the width of slot 43.

Figure 4:
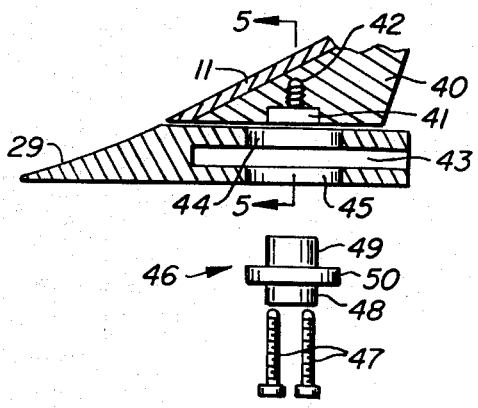
FIG. 4 is an exploded section view of the mold board taken through the plane indicated in FIG. 2.
Figure 5:
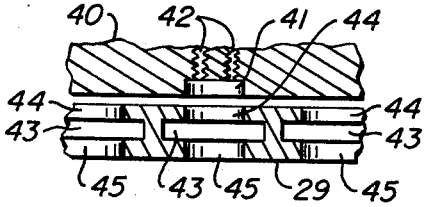
FIG. 5 is a section view of the mold board taken through the plane indicated in FIG. 4 without the tool stop and guide post.

To install each post 46, it is inserted through one of the passages of cutter blade 29 comprising holes 44 and 45 and recess 43 with the elongation of middle portion 50 aligned with the direction of motion of cutter blade 29, as shown in FIG. 4, until the upper end of post 46 bottoms on recess 41; post 46 is then rotated by 90° so the elongation of middle portion 50 is transverse to the direction of motion of cutter blade 29; and bolts 47 are threaded into bores 42 to secure post 46 to blade stop support 40. It is, in general, desirable to make cutter blade 29 as light as possible without compromising its strength and rigidity, so as to maximize the transfer of vibration energy to the earth. The presence of slots 43 substantially reduces the weight of cutter blades 29 and middle portions 50 of posts 46 protect against vertical thrust, i.e., maintain horizontal rigidity while part of cutter blade 29 is out of contact with the ground by bearing against the top and/or bottom surfaces of slots 43, and protect cutter blade 29 against side thrust by bearing against the side surfaces of slots 43.

As a blade base 29 reciprocates fore and aft, middle portions 50 of posts 46 ride in slots 43, thereby guiding cutter blade 29 and taking up side and vertical thrust; end portions 48 and 49 ride in holes 44 and 45, respectively, thereby limiting the stroke of cutter blade 29, acting as stops on its aft motion, and further guiding it fore and aft. Specifically the maximum stroke of cutter blade 29 is equal to the difference between the major diameter of holes 44 and 45 and the diameter of end portions 48 and 49.

A pair of angulated force transmitting resonant beams 55 are disposed behind mold board 11 between brackets 26 and 27. Beams 55 are matched in the sense that they resonate at the same frequency, have the same dimensions, and are made from the same material. Each of beams 55 has in a one piece cast or machined construction divergent, approximately straight legs 56 and 57 that meet at a juncture 58 to form an acute, approximately 90° angle, a oscillator housing 59 at the end of leg 56, a hammer 60 at the end of leg 57, an inward extension 64 bisecting the angle between legs 56 and 47, and transverse mounting flanges 65 and 66 formed on the end of extension 64. When restrained at juncture 58, each beam 55 has a node at juncture 58 and anti-nodes at the ends of legs 56 and 57, when excited at or near an appropriate resonant frequency. The anti-node at the end of leg 56 serves as an input of the beam and the anti-node at the end of leg 57 serves as the output of the beam.

Legs 56 and 47 are each tapered in thickness from juncture 58 to their respective ends, i.e., as depicted in FIG. 1 each leg is wider near the juncture than it is near its end, for the purpose of equalizing the bending stresses along the length of each leg. A taper of 30%, i.e., a beam thickness at the juncture to a beam thickness at the end of each leg in a ratio of 10:7, has been found in preliminary testing to equalize well the bending stresses along the lengths of the legs. By thus tapering the thickness of legs 56 and 57 to equalize the internal bending stresses along their lengths, more oscillator force can be applied to the input anti-node for a given beam weight without danger of damaging the beam structure.

It has been discovered that for an angulated beam having legs of equal length, the input leg, i.e., the leg to which the oscillator is coupled, is subjected to more bending stress than the output leg, i.e., the leg that delivers impulses to the cutter blade. To equalize the bending stresses in the two legs, the output leg is designed to be longer than the input leg, which preliminary testing indicates to be preferably in a ratio of approximately 4:3.

An oscillator is disposed in housing 59. Such oscillator comprises at least one, and preferably two eccentric weights 61 mounted on a shaft 62, which is journalled for rotation in housing 59. Preferably, the weight of hammer 60 is equal to or less than the weight of the oscillator, including its housing, shaft, bearings, and eccentric weights. If hammer 60 is too heavy, the input anti-node vibrates with a larger amplitude than the output anti-node. A motor 70 (FIG. 2) is shock mounted through resilient pads 72 to a horizontal bracket 73, which is attached to vertical brackets 27, for example by welding.

Preferably, motor 70 is a hydraulic motor driven by a hydraulic pump located on the tractor and not shown. Motor 70 is turned on and off and its speed is preset. Motor 70 is coupled by double universal joints and flywheels to the oscillators at the input nodes of beams 55.

Mounting pads 62 and 63 are formed on the rear surface of mold board 11. Beams 55 are each mounted on the back of mold board 11 by bolding flanges 65 and 66 onto pads 62 and 63, respectively. Shims 67 and 68 are interposed between flange 65 and pad 62 and between flange 66 and pad 63, respectively, to precisely set at the time of assembly and readjust in the course of operation, the position of hammer 60 with respect to 29. As depicted in FIG. 1, mold board 11 has a concave front earth-working surface and a correlative convex rear surface. Pads 62 and 63 are so located that mold board 11 extends into the space between legs 56 and 57, with housing 59 disposed near the top and slightly aft of the front of mold board 11 and hammer 60 disposed near the bottom of mold board 11 within striking distance of cutter blade 29.

As eccentric weights 61 rotat on shaft 62 at or near (usually slightly less than) the resonant frequency of beam 55, beam 55 is excieted into at least near resonant vibration. The input anti-node at the end of leg 56 vibrates transversely to its length, and the output anti-node of leg 57 vibrates transversely to its length, and hammer 60 intermittently strikes the back of cutter blade 29 with each forward excursion of the output anti-node.

Figure 3:
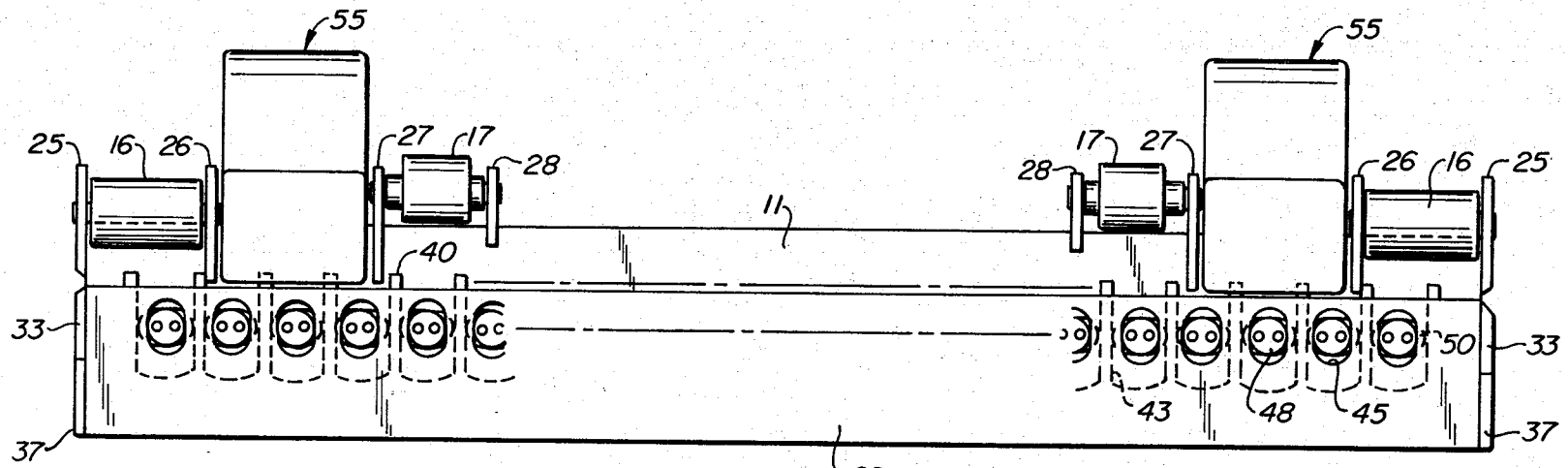
FIG. 3 is a bottom plan view of the mold board of the bulldozer.

The neutral position of the output anti-node of each beam 55 is defined herein as its position when beam 55 is at rest, i.e., when it is not vibrating or being deflected. Regardless of the position of cutter blade 29, it is at all times spaced forwardly from the neutral position of the output anti-node of each beam 55, thereby forming a gap. When each beam 56 is energized by its oscillator, its output anti-node vibrates, i.e., reciprocates, fore and aft; disregarding the continuous forward movement of mold board 11, as the output anti-node moves forward, the gap closes and strikes the back of cutter blade 29 and as it moves aft, the gap opesn. A minimum protective gap is established between the neutral position of the output anti-node of each beam 55 and cutter blade 29. Specifically, herein the front surface of portions 48 and 49 of posts 46 serve as tool stops on the aft movement of cutter blade 29 when they contact the front surface of holes 44 and 45, respectively (FIG. 3). The desired minimum protective gap is established by the number of shims 67 and 68, which changes the spacing between each beam 55 and blade 29, including tool stop and guide posts 46.

Figure 6C:
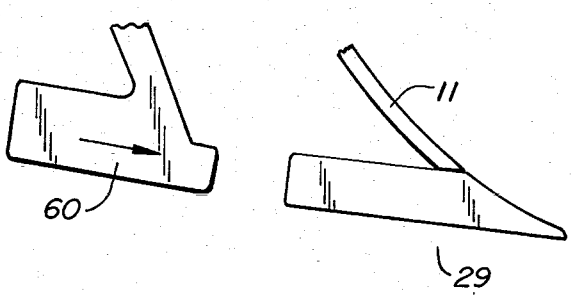
FIGS. 6A, 6B and 6C are schematic diagrams of the mold board depicting the mode of operation of the invention.
Figure 6B:
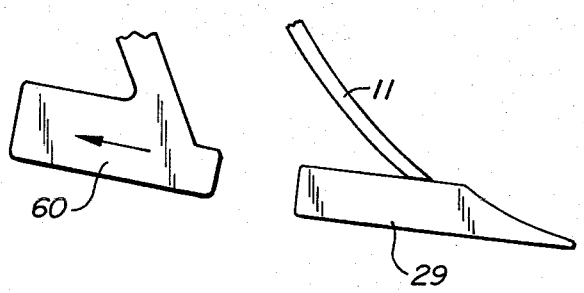
Figure 6A:
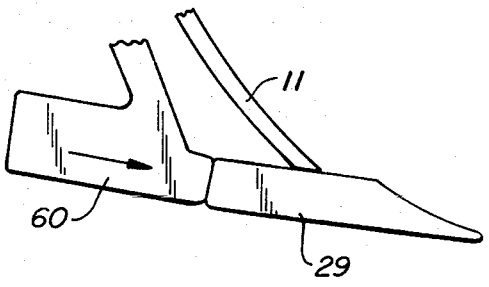

Reference is made to FIGS. 6A, 6B and 6C, in which the spacing between elements is exaggerated for illustrative purposes, to describe further the mode of operation of the output anti-node of each beam 55. Generally, the peak-to-peak vibration excursion amplitude of each output anti-node would be of the order of one inch. In FIG. 6A, hammer 60 is shown in contact with cutter blade 29 at the forward peak of the vibration excursion of the output anti-node. Hammer 60 drives cutter blade 29 forward relative to mold board 11. As hammer 60 moves aft, out of contact with cutter blade 29, cutter blade 29 remains stationary relative to the ground, while mold board 11 continues to move forward, as depicted in FIG. 6B, which shows hammer 60 as the outlet anti-node approaches its aft peak. FIG. 6C depicts hammer 60 moving forward as it passes through the neutral position about to strike cutter blade 29. When hammer 60 strikes cutter blade 29, it drives cutter blade 29 forward to the position depicted in FIG. 6A and the cycle is repeated. In this manner, hammer 60 applies unidirectional force impulses to cutter blade 29 to drive cutter blade 29 intermittently in a forward direction without aft motion as tractor 12 moves steadily forward. Relative to mold board 11, cutter blade 29 reciprocates as tractor 12 drives mold board 11 steadily forward.

It is preferred to synchronize the force impulses applied by both of beams 55 to cutter blade 29. This is also accomplished by selecting the number of shims 67 and 68 that are used. For example, fewer shims 68 vis-a-vis shims 67 for one of beams 55 will position surface 69 of such beam closer to cutter blade 29.

The angulated resonant beams 55 employed to vibrationally aid dozer operation have the following advantages, vis-a-vis, a straight, elongated resonant beam: First the angulated beams conform to the convext curvature of the rear surface of the mold board, thereby avoiding interference with the dozing operation; second, in addition to the vibration energy transferred to cutter blade 29, substantial, albeit less, such energy is transferred directly to mold board 11 through extension 64 and flanges 65 and 66 by virtue of a tendency for juncture 58 to vibrate back and forth approximately parallel to extensions 64, thereby effectively fluidizing the earth in the vicinity of mold board 11; third, whereas the nodes of a straight resonant beam shift with changing conditions, the single node of an angulated beam remains essentially fixed; fourth, whereas the node support of a straight resonant beam is subject to bending stress, the node support of the disclosed angulated beam, namely, pads 62 and 63 and flanges 65 and 66, does not flex because it is offset laterally from the juncture where flexure occurs.

In general, it is desirable to select a resonant frequency for beams 55 and a matching frequency for the oscillator that is low enough to transmit energy to the earth in the vicinity of mold board 11 without undue damping, and high enough to couple substantial energy to the earth. As a result, the surrounding earth is effectively fluidized by the energy transferred through mold board 11 and blad 20. A frequency of approximately 30–60 Hz has been found in preliminary testing to fluidize effectively the earth in the vicinity of the mold board, i.e., as far as 10 feet or more away therefrom.

In a typical embodiment, the mold board is 10 feet across and 4 feet high, cutter blade 29 weighs approximately 500 pounds, the diameter of portions 48 and 49 is $3\frac{1}{4}$ inches, the length of the major axis of holes 44 and 45 is $4\frac{3}{4}$ inches, and the dimensions of each resonant beam 55 are as follows: length of leg 56 is 2 feet; length of leg 57 is $2\frac{2}{3}$ feet; width of the beam is 1 foot; total distance from leg 57 to the end of oscillator housing 59 is $3\frac{1}{8}$ feet; total distance from leg 56 to the end of hammer 60 is $3\frac{1}{2}$ feet; maximum thickness of legs 56 and 57 is $2\frac{1}{2}$ inches; minimum thickness of legs 56 and 57 is $1\frac{7}{8}$ inches; weight of the beam (steel) is approximately 800 pounds; resonant frequency of the beam is approximately 40 Hz; and oscillator force is 6,500 pounds.

The disclosed angulated resonant beams could be utilized to advantage in other types of earth-working equipment, such as front-end loaders, shovel buckets, and the like. In each case, the earth-working implement, e.g., mold board or bucket, has a concave front earth-working surface, a correlative convex rear surface, and a transversely extending bottom edge. In one embodiment, the beam or beams are mounted adjacent to the rear surface of the implement so the implement extends into the space between legs with the input anti-node of the beam disposed near the top of the implement aft of its front edge and the output anti-node disposed near the bottom of the implement within striking distance of the cutter blade, which extends across the bottom edge of the implement. In another embodiment the beam or beams are mounted adjacent to the front surface of the implement outside the earth contacting volume thereof. Such arrangements have the advantages enumerated above in connection with the described bulldozer.

The described embodiment of the invention is only considered to be preferred and illustrative of the inventive concept; the scope of the invention is not to be restricted to such embodiment. Various and numerous other arrangements may be devised by one skilled in the art without departing from the spirit and scope of this invention. The term bulldozer and the like is intended to include earth-working equipment of the type having a mold board such as a grader or a scraper as well as a bulldozer. A mold board is regarded as an implement that pushes and levels earthen material rather than lift and carry it.

What is claimed is:

1. A bulldozer or the like comprising:

a tractor;

a transversely elongate mold board having a bottom edge;

means for coupling the mold board to the tractor for dozing purposes;

a transversely elongate cutter blade closely spaced from the bottom edge of the mold board;

means for mounting the cutter blade for reciprocal motion in forward and aft directions relative to the mold board;

means for resonantly applying unidirectional force impulses to the blade in a forward direction to drive the blade intermittently forward without aft motion; and means for rigidly mounting the unidirectional force applying means on the mold board so that a portion of the force impulses are transmitted to the mold board.

2. The bulldozer of claim 1, in which the unidirectional force applying means comprises:

a force transmitting beam having a resonant frequency and at least one node and first and second anti-nodes at the resonant frequency;

a source of vibrations at or near the resonant frequency coupled to the beam near the first anti-node; and means for attaching the beam near the one node to the mold board so as to position the beam near the second anti-node in spaced aft relationship from the cutter blade within striking distance thereof.

3. The bulldozer of claim 2, in which the resonant beam has two divergent approximately straight legs that meet at a juncture and form an angle of approximately 90°, the first anti-node being located at the end of one leg, the second anti-node being located at the end of the other leg, and the one node being located at the juncture.

4. The bulldozer of claim 3, in which the juncture of the beam has an inward extension forming a part of the beam, the extension bisecting the angle between the legs of the beam and transverse mounting flanges formed on the end of the extension, the beam attaching means comprising means for securing the flanges to the mold board.

5. The bulldozer of claim 4, in which the beam attaching means additionally comprises shims disposed between at least one of the flanges and the mold board to adjust the position of the end of the other leg relative to the cutter blade.

6. The bulldozer of claim 2, in which the beam vibrates about a neutral position, the cutter blade mounting means additionally comprising means for preventing aft movement of the cutter blade beyond a point forwardly spaced from the neutral position.

7. The bulldozer of claim 6, in which the preventing means comprises a cutter blade stop support secured to the back of the mold board at the bottom thereof and extending across the mold board from side-to-side, a plurality of elongated slots formed in the cutter blade in alignment with the direction of movement thereof, and a plurality of posts attached to the support and riding in the slots to stop the cutter blade when the ends of the slots reach the posts.

8. The bulldozer of claim 1, in which the unidirectional force applying means comprises:

first and second matched force transmitting beams each having a resonant frequency and at least one node and first and second anti-nodes at the resonant frequency;

first and second sources of vibrations at or near the resonant frequency coupled to the respective beams near the first anti-node; and means for attaching the respective beams near the one node to the mold board at transversely spaced points so as to position the respective beams near the second anti-node in spaced aft relationship from the cutter blade within striking distance thereof at transversely spaced points.

9. The bulldozer of claim 1, in which the cutter blade mounting means additionally comprises guiding means for preventing sideward motion of the cutter blade.

10. The bulldozer of claim 9, in which the guiding means comprises a guide support secured to the back of the mold board from side-to-side, a plurality of elongated slots formed in the cutter blade in alignment with the direction of motion thereof, and a plurality of posts attached to the support, the posts each having protrusions elongated transverse to the direction of cutter blade motion riding in the respective slots.

11. The bulldozer of claim 1, in which the force impulses have a frequency of approximately 30–60 Hz.

12. The bulldozer of claim 1, wherein mold board is coupled to the front end of the tractor.

13. Earth-working equipment comprising:

a vehicle;

an earth-working implement having a concave, front earth-working surface, a correlative rear convex surface, and a transversely extending bottom edge;

means for coupling the implement to the vehicle;

a force transmitting beam having two divergent approximately straight legs that meet at a juncture to form approximately a right angle, the beam having a resonant frequency and a node at the juncture, a first anti-node at the end of one leg, and a second anti-node at the end of the other leg at the resonant frequency, the beam further having an inward extension projecting from the juncture in a direction which generally bisects the acute angle;

a source of vibrations at or near the resonant frequency coupled to the beam near the first anti-node; and means for mounting the inward extension directly to the rear surface of the implement so the implement extends into the space between the legs with the first anti-node disposed near the top of the implement and the second anti-node disposed near the bottom of the implement; and a cutter blade extending across the bottom edge of the implement, the cutter blade being coupled to the second anti-node so that the beam applies forwardly directed forces to the cutter blade to drive the blade into the earth.

14. The equipment of claim 13, in which the acute angle between the legs is approximately 90°.

15. The equipment of claim 13, in which the cutter blade mounting means comprises means for pivotably mounting the cutter blade on the implement.

16. The equipment of claim 13, in which the implement comprises a bulldozer mold board.

17. The equipment of claim 13, additionally comprising a hammer on the end of the leg forming the second anti-node.

18. The equipment of claim 17, in which the hammer weighs no more than the source of vibrations.

19. The equipment of claim 17 in which the hammer weighs approximately the same as the source of vibrations.

20. The equipment of claim 13, in which the source of vibrations comprises an oscillator housing formed on the end of the leg forming the first anti-node as part of the beam in a one-piece construction, a shaft journaled for rotation in the housing, and at least one eccentric weight mounted on the shaft.

21. The equipment of claim 13, in which the second anti-node vibrates about a neutral position, the equipment additionally comprising means for preventing rearward movement of the cutter blade beyond a point spaced forwardly of the neutral position.

22. The equipment of claim 13, additionally comprising:

means for mounting the cutter blade in downward closely spaced relationship from the bottom edge of the implement for reciprocal motion to fore and aft directions relative to the bottom edge of the implement; and the mounting means mounting the beam with the second anti-node disposed in spaced aft relationship from the cutter blade within striking distance thereof.

23. Earth-working equipment comprising:

a vehicle;

a transversely elongate earth-working implement having a concave, front earth-working surface, a correlative rear convex surface, and a transversely extending bottom edge;

means for coupling the implement to the vehicle;

a transversely elongate cutter blade extending across the bottom edge of the implement;

means for mounting the cutter blade in downward closely spaced relationship from the bottom edge of the implement for reciprocal motion in fore and aft directions relative to the bottom edge of the implement;

first and second force transmitting beams each having two divergent approximately straight legs that meet at a juncture to form approximately a right angle, a resonant frequency and a node at the juncture, a first anti-node at the end of the one leg, a second anti-node at the end of the other leg at the resonant frequency, and an inward extension projecting from the juncture in a direction which generally bisects the acute angle;

a source of vibrations at or near the resonant frequency coupled to each of the first and second beams near the first anti-node;

means for mounting the first and second beams adjacent to the rear surface of opposite sides of the implement by attaching their respective inward extensions thereto so that the implement extends into the space between the legs of each beam with the first anti-node disposed near the top of the implement and the second anti-node disposed near the bottom of the implement within striking distance of the cutter blade to drive the cutting blade through the earth.

24. A bulldozer or the like comprising;

a tractor;

a transversely elongate mold board having a bottom edge;

means for coupling the mold board to the tractor for dozing purposes;

a transversely elongate cutter blade closely spaced from the bottom edge of the mold board;

means for mounting the cutter blade for reciprocal motion in forward and aft directions relative to the mold board;

means for applying unidirectional force impulses to the blade in a forward direction to drive the blade intermittently forward without aft motion; and guiding means for preventing sideward motion of the cutter blade, the guide means including a guide support secured to the back of the mold board from side-to-side, a plurality of elongated slots formed in the cutter blade in alignment with the direction of motion thereof, and a plurality of posts attached to the support, the posts each having protrusions elongated transverse to the direction of cutter blade motion riding in the respective slots.

* * * * *